United States Patent [19]

Vote

[11] Patent Number: 4,578,825

[45] Date of Patent: Apr. 1, 1986

[54] SMOCK OR GOWN

[76] Inventor: Marjean D. Vote, 2323 - 26th St., Des Moines, Iowa 50310

[21] Appl. No.: 757,723

[22] Filed: Jul. 22, 1985

[51] Int. Cl.[4] ..... A41D 13/00; A41B 9/00

[52] U.S. Cl. ..... 2/114; 2/DIG. 7

[58] Field of Search ..... 2/114, DIG. 7, 73, 74, 2/75, 69

[56] References Cited

U.S. PATENT DOCUMENTS

| | | | |
|---|---|---|---|
| D. 193,132 | 7/1963 | Rhoads | 2/DIG. 7 |
| D. 233,634 | 11/1974 | Snider | 2/DIG. 7 |
| 2,556,931 | 6/1951 | Miller | 2/114 |
| 2,686,914 | 8/1954 | Weiser | 2/114 |
| 2,818,573 | 1/1958 | O'Donnell | 2/114 |
| 3,129,432 | 4/1964 | Belkin | 2/114 |
| 3,160,891 | 12/1964 | MacDonald | 2/114 X |
| 3,369,256 | 2/1968 | Kern | 2/114 |
| 3,696,443 | 10/1972 | Taylor | 2/114 |
| 3,911,499 | 10/1975 | Benevento et al. | 2/114 |

*Primary Examiner*—H. Hampton Hunter

*Attorney, Agent, or Firm*—Henderson & Sturm

[57] ABSTRACT

The invention comprises a gown (10) having a front unit (11) with a pair of identical front panels (12), (13) arranged in reverse relationship whereby the front unit (11) has an open neck and overlapping front flap portions (22), (22') which may be partially or completely opened for exposing certain parts of the body; and further a rear unit (14) having a pair of identical rear panels (16), (17) also arranged in a reverse relationship with identical neck margins (27), (27') registered with each other, and with left and right shoulder margins (26), (26') and (28), (28') formed.

The front and rear pairs of panels (12), (13) and (16), (17), respectively, in their reverse overlapping arrangement, are placed together with their outer shoulder margins (21), (21') and (26) (26') registered, then secured as by stitching, and with their side margins (19), (19') and (24), (24') registered, then secured as by stitching while leaving arm openings, such that full overlapping flap margins (22), (22') and (29), (29') are provided front and rear of the gown (10), the front completely openable at both sides of the neck margins (27), (27').

7 Claims, 4 Drawing Figures

SMOCK OR GOWN

TECHNICAL FIELD

The present invention relates generally to a gown, and more particularly to a smock or medical gown.

BACKGROUND ART

Gowns or smocks of either three-quarter or full length, with full length openings either front or rear, are well known. Such gowns often have partial or full length sleeves, belts and other fastening devices for detachably fastening pairs of flaps together for cleanliness or modesty purposes. Likewise, the full or partial overlapping of flaps provides ample means of spreading apart certain portions of the gown for medical examination purposes while maintaining proper decorum for the patient.

An example of presently used hospital gowns is shown in U.S. Pat. No. Des. 233,634 issued Nov. 19, 1974 to D. R. Snider. The objections to this gown are extreme lack of modesty, inefficiency as to posterior examination and the need to wear another garment beneath for the sake of modesty. U.S. Pat. No. 2,818,573 issued Jan. 7, 1958 to P. O'Donnell is an improvement over Snider as to modesty and efficiency; however, utilization of the front panels are limited due to their inability to open completely to the shoulders and the gown is awkward and difficult to put on and take off in view of its full neck and overlapping front flap secured to an opposite shoulder.

DISCLOSURE OF THE INVENTION

The above problems are substantially resolved, without undue compromise of other desirable attributes that are already provided by prior art devices, by the provision of the invention disclosed herein.

The present invention relates generally to a gown and more particularly to a smock or medical gown.

In particular, the invention comprises a gown having a front unit having a pair of identical front panels arranged in reverse relationship, whereby the front unit has an open neck and overlapping front flap portions which may be partially or completely opened for medical examination of the front and/or sides of a patient, and further of the upper or lower front area of a patient while maintaining modesty of the remaining frontal area. The gown comprises further a rear unit having a pair of identical rear panels also arranged in reverse relationship with identical neck margins registered with each other, and connected as by stitching and with left and right shoulder margins formed.

The front and rear pairs of panels are placed together with shoulder margins of each left front panel and left rear panel registered for connection as by stitching, and with the same arrangement with the right front and right rear panel shoulder margins. A rear flap or fold is formed thereby extended from the bottom hem of the gown at a rear panel to the neck and shoulder margins. This arrangement of full overlapping flaps or folds in the rear provide excellent modesty protection while in any postural condition of the patient and provides simultaneously for example, exposure of the back and/or rear of a patient again with a maximum of modesty protection for the remainder of the patient's body.

Importantly, an object of this invention is provided by the construction of the gown providing extreme ease of putting it on and taking it off, thus accommodating most patients regardless of injury or condition, while retaining and even improving upon the modesty and examination qualities of the gown by providing a full opening front and a full flap opening rear pattern.

Another object of the invention is to provide the aforementioned objectives while providing the gown with a simple but effective, uncomplicated, pattern construction.

BRIEF DESCRIPTION OF THE DRAWINGS

These and other attributes of the invention will become more clear upon a thorough study and review of the following detailed description of the best mode for carrying out the invention, particularly when reviewed in conjunction with the drawings, wherein.

BEST MODE FOR CARRYING OUT THE INVENTION

Figure 1:
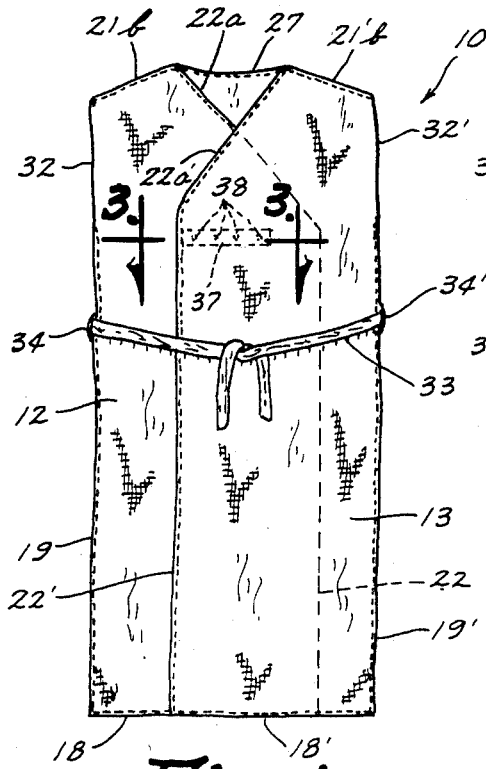
FIG. 1 is a front elevational view of a gown constructed in accordance with the invention.

Referring now to the drawings, the gown of this invention is depicted generally at (10) in FIG. 1. It comprises generally a front unit (11) having identical left and right front panels (12), (13), respectively of cloth, and a rear unit (14) also having identical left and right rear panels (16), (17), respectively, (FIG. 2), of cloth.

Figure 4:
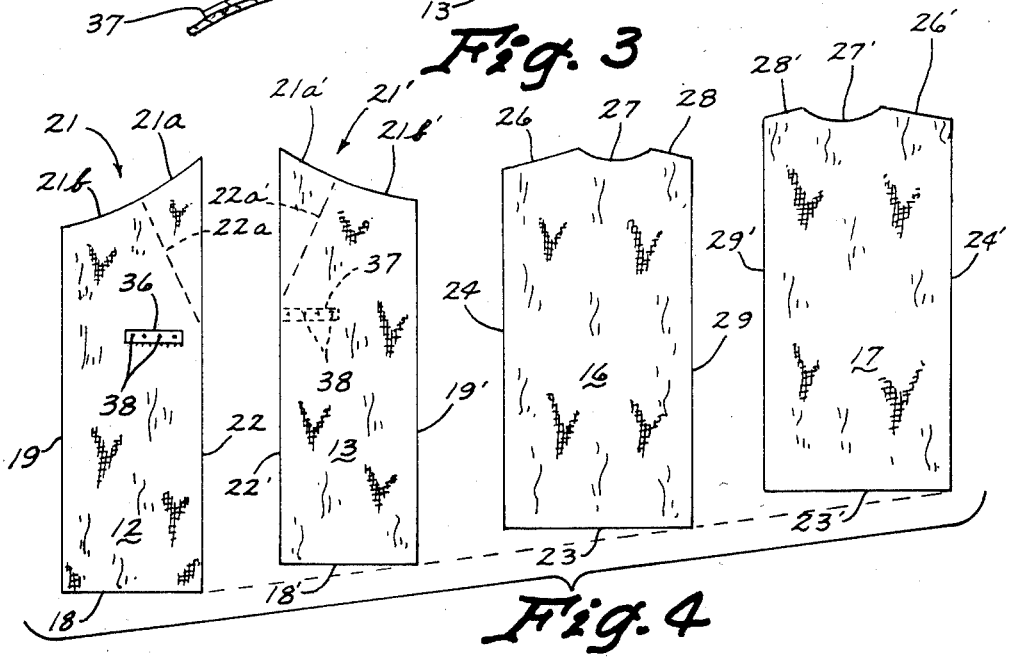
FIG. 4 is an exploded view in front elevation of the four panels which comprise the gown disclosing their respective patterns prior to their fastening as by sewing.

Referring to FIG. 4, the panels (12), (13), (16) and (17) are illustrated in exploded form, and are shown in their full pattern shape prior to being folded or sewn in any manner for assembly purposes. Each front panel (12) and (13) being identical, although assembled in reverse or opposite pattern as illustrated, only one will be described, but the prime indicia on the right panel (13) will be used to differentiate its margins from those of the left panel (12).

Each panel (12), (13) has a bottom margin (18), (18'), a side margin (19), (19'), a shoulder margin (21), (21'), and an inner flap margin (22), (22'). As illustrated, the bottom, side and flap margins of each front panel (12), (13) have a right angular shape, with the shoulder margins extended on a diagonal between the side and flap margins to complete the shape of each pattern.

Similarly to the front panels (12), (13), each rear panel (16), (17) has a bottom margin (23), (23'), a side margin (24), (24'), a full shoulder margin (26), (26') adjoining the side margin (24), (24'), a neck margin (27), (27'), and a partial shoulder margin (28), (28') extended from the neck margin (27), (27') oppositely the full shoulder margin (26), (26'), and an inner flap margin (29), (29'). Similar to the front panels (12), (13), the bottom, side and flap margins have a right angular shape along the bottom of each panel, with the shoulder margins (26), (26'), (28), (28') and neck margins (27), (27') of each rear panel extended unevenly between their respective side and flap margins to complete the general rectangular shape.

Prior to joining any of the panels, the bottom, side and flap margins (18), (18'), (19), (19'), and (22), (22'), respectively, of each of the front panels (12), (13) may be hemmed; and the bottom, side and flap margins (23), (23'), (24), (24') and (29), (29') of the rear panels (16), (17) may also be hemmed. The shoulder margin (21), (21') of each front panel (12), (13) is folded upon itself, see dotted lines in FIG. 4, such that each half (21*a*), (21*a'*) of each shoulder margin registers with the other half (21*b*), (21*b'*) thereof, leaving a portion (22*a*), (22*a'*) of the flap margins (22), (22') folded across the face of its respective front panel (12), (13).

One method of assembling the four panels is as follows: place rear panel (16) over rear panel (17) (FIG. 4) such that the neck margins (27), (27') register with each other. This leaves partial shoulder margin (28) overlying part of full shoulder margin (26') and partial shoulder margin (28') underlying part of full shoulder margin (26). It further leaves inner flap margin (29) overlapping inner flap margin (29') such that when viewed from the rear (FIG. 2), right rear panel (17) is the outermost panel of the rear unit (14). The neck margins (27), (27') are then stitched together, and then folded and top stitched.

Each portion (22*a*), (22*a'*) of the side margins having been folded, their registered halves (21*a*),(21*b*), and (21*a'*), (21*b'*) are top stitched. The combined shoulder margins (21), (21*a*) of the left front panel (12) are then placed over and registered with the full shoulder margin (26) of the left rear panel (16) and the partial shoulder margin (28') of the right rear panel (17), and all stitched together. Likewise, the combined shoulder margins (21*a'*), (21*b'*) of the right front panel (13) are placed over and registered with the partial shoulder margin (28) of the left rear panel (16) and the full shoulder margin (26') of the right rear panel (17) all stitched together. The side margins (19) and (24) of the front panel (12) and left rear panel (16) are stitched together as well as the side margins (19') and (24') of the right front and right rear panels (13) and (17), respectively, leaving however open margins adjacent the upper portions thereof to form arm openings (32), (32') (FIG. 1).

When the front and rear unit (11) and (14) are joined together (FIGS. 1 and 2), it will be noted that the transverse width of each of the front panels (12), (13), and of each of the rear panels (16), (17), is greater than half the width of the gown (10), thereby providing a full overlapping for both the front and rear pairs of panels.

Figure 2:
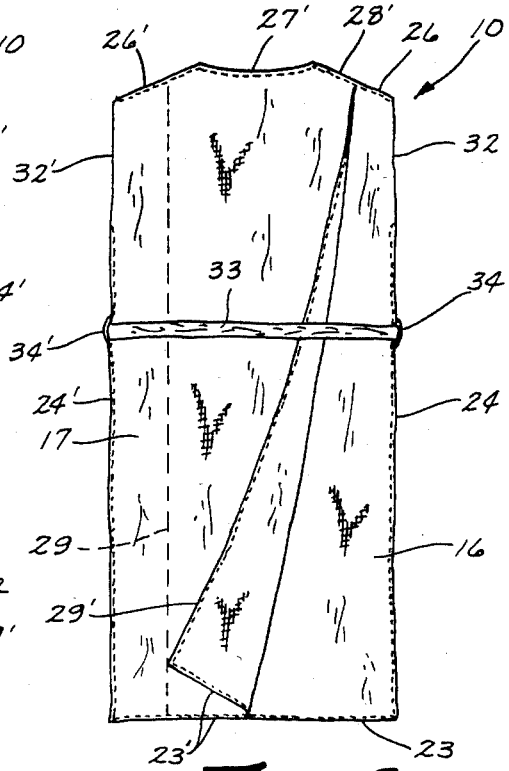
FIG. 2 is a rear elevational view of the gown.
Figure 3:
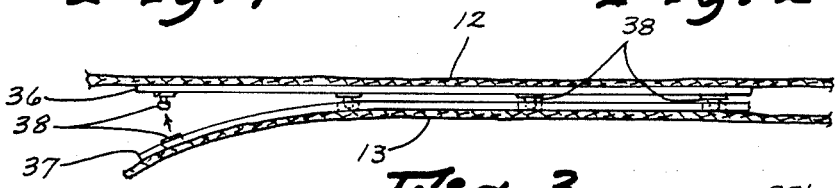
FIG. 3 is an enlarged sectional view of an optional fastener unit for the front of the gown, taken along the line 3—3 in FIG. 1.

To hold the front and rear units (11) and (14) loosely together if desirable, two optional acessories are provided. A belt (33) may be threaded through a pair of loops (34), (34') secured to the opposed sides of the gown (10) (FIGS. 1 and 2). The alternate fastening device comprises a pair of cloth strips (36), (37) secured as by stitching, to the outside and inside, respectively of the left and right front strips (12) (13). Plastic snap closure units (38) are secured to the panels (36), (37) in a conventional manner whereby the panels (12), (13) may be detachably fastened together. The material of the gown may be of any cloth, but a blend of 65% cotton-35% Dacron is preferred.

Due to the wide overlap of the margins (22), (22'), and the front left and right panels (12), (13) open from the shoulder and neck margins to the bottom margins, complete examination of various parts of the body is possible without completely uncovering the body. Furthermore, the gown may be put on and taken off by inserting the arms through the openings (32), (32') or sleeves (42), (43) and wrapping the front panels about the body; as compared to having to place the gown over the head before inserting the arms through arm or sleeve openings.

Several optional features and accessories include: adding sleeves (not shown) of various lengths to the arm openings (32), (32'); changing the length of the side and flap margins of both units (11), (14), thus changing the length of the gown (10); adding decorative elements such as ruffles to the neckline; adding pockets; and providing pants of varying length for wear beneath the gown, for example.

Further, although the invention has been described in terms of a gown for use primarily for medical examination, its uses may include laboratory technician smock, artist's smock, repair person smock, nurse's scrub suit, a nursing or birthing gown—the neckline being cut deeper, and a personal robe.

Obviously, many modifications and variations of the present invention are possible in light of the above teachings. It is therefore to be understood, that within the scope of the appended claims, the invention may be practiced otherwise than as specifically described therein.

I claim:

1. A gown comprising:

a front unit having a pair of identical front panels of cloth, each front panel having a bottom margin, a side margin, a shoulder margin, and an inner flap margin, the transverse width of each front panel between said side and inner flap margins being more than half the width of the gown;

a rear unit having a pair of identical rear panels of cloth, each rear panel having a bottom margin, a side margin, a neck margin, a shoulder margin and an inner flap margin, the transverse width of each rear panel between said side and inner flap margins being more than half the width of the gown;

said rear panels placed with their inner flap margins overlapping and their neck margins registered, said front panels placed with their inner flap margins overlapping, said combined front panels placed over said combined rear panels with the shoulder margin of one front panel registered with the shoulder margin of one rear panel, the side margins of said one front and one rear panel registered, and with the shoulder margin of the other front panel registered with the shoulder margin of the other rear panel, the side margins of said other front and other rear panels registered; and said rear panel neck margins stitched together, said one front panel and one rear panel shoulder margins stitched together, said other front panel and other rear panel shoulder margins stitched together, said one front and one rear panel side margins stitched together, and said other front and other rear panel side margins stitched together, the stitching of said pairs of side panels extended from their ends at said bottom margins to a portion spaced from their ends at said shoulder margins to form arm openings.

2. A gown as defined in claim 1 and wherein said shoulder margin of each front panel is foldable upon itself such that each half of a said shoulder margin registers with the other half, leaving a portion of said flap margin beginning at its juncture with the shoulder margin folded across the face of its respective front panel.

3. A gown as defined in claim 1 and wherein each rear panel includes further a partial shoulder margin extended outwardly from the side of said rear panel neck margin opposite said rear panel shoulder margin, said partial shoulder margin terminated at its juncture with the adjacent said rear panel side margin.

4. A gown as defined in claim 1 and wherein the length of said front and rear unit is adjustable.

5. A gown as defined in claim 1, and wherein a cylindrical section of cloth is stitched at one end thereof to each of said side panels arm opening forming thereby a sleeve on each side of the gown.

6. A gown as defined in claim 1, and wherein a pair of loops of cloth are stitched to each side of the front and rear units where said side panels are joined, and a length of cloth forming a belt is adapted to be threaded through said loops.

7. A gown as defined in claim 1, and wherein fastening means are attached to said front panels adjacent said inner flap margins thereof, for detachably fastening said front flaps together in an overlapping arrangement.

* * * * *